US011814704B2

(12) United States Patent
Baker et al.

(10) Patent No.: US 11,814,704 B2
(45) Date of Patent: Nov. 14, 2023

(54) HIGH STRENGTH THERMALLY STABLE NICKEL-BASE ALLOYS

(71) Applicant: Huntington Alloys Corporation, Huntington, WV (US)

(72) Inventors: Brian A. Baker, Kitts Hill, OH (US); John J. Debarbadillo, Barboursville, WV (US)

(73) Assignee: HUNTINGTON ALLOYS CORPORATION, Huntington, WV (US)

( * ) Notice: Subject to any disclaimer, the term of this patent is extended or adjusted under 35 U.S.C. 154(b) by 0 days.

(21) Appl. No.: 17/575,263

(22) Filed: Jan. 13, 2022

(65) Prior Publication Data

US 2022/0220582 A1 Jul. 14, 2022

Related U.S. Application Data

(60) Provisional application No. 63/136,668, filed on Jan. 13, 2021.

(51) Int. Cl.

| | |
|---|---|
| ***C22C 19/05*** | (2006.01) |
| ***C21D 1/26*** | (2006.01) |
| ***C22F 1/10*** | (2006.01) |

(52) U.S. Cl.

CPC ..... *C22C 19/055* (2013.01); *C21D 1/26* (2013.01); *C22C 19/056* (2013.01); *C22F 1/10* (2013.01)

(58) Field of Classification Search

CPC ..... C22C 19/056; C22C 19/055; C22F 1/10

See application file for complete search history.

(56) References Cited

U.S. PATENT DOCUMENTS

2004/0184946 A1* 9/2004 Tominaga ..... C22C 19/056 420/586.1
2015/0368774 A1* 12/2015 Ota ..... F01D 5/28 148/419

FOREIGN PATENT DOCUMENTS

| | | |
|---|---|---|
| EP | 1095167 | 5/2001 |
| EP | 2743362 | 6/2014 |
| EP | 3584335 | 12/2019 |

OTHER PUBLICATIONS

Wasson, A. J., and G. E. Fuchs. "The effect of carbide morphologies on elevated temperature tensile and fatigue behavior of a modified single crystal Ni-base superalloy." Proceeding at conference, Superalloy. 2008.*

International Search Report issued in corresponding International Application PCT/US2022/012323, dated Apr. 20, 2022.

Viswanathan, et al., Boiler Materials for Ultra-Supercritical Coal Power Plants-Steamside Oxidation, Journal of Materials Engineering and Performance, Jun. 2006, pp. 255-274, vol. 15(3).

* cited by examiner

*Primary Examiner* — Jessee R Roe

(74) *Attorney, Agent, or Firm* — Burris Law, PLLC

(57) ABSTRACT

An alloy includes a composition, in weight percent, of aluminum from about 1.3% to about 1.8%, cobalt from about 1.5% to about 4.0%, chromium from about 18.0% to about 22.0%, iron from about 4.0% to about 10.0%, molybdenum from about 1.0% to about 3.0%, niobium from about 1.0% to about 2.5%, titanium from about 1.3% to about 1.8%, tungsten from about 0.8% to about 1.2%, carbon from about 0.01% to about 0.08%, and balance nickel and incidental impurities. The alloy has a stress rupture life at 700° C. and 393.7 MPa (57.1 ksi) of at least 300 hours and a room temperature percent elongation of at least 15% after aging at 700° C. for 1,000 hours.

32 Claims, 2 Drawing Sheets

| Weight % | C K | O K | Ni L | Al K | W M | Nb L | Mo L | Ti K | Cr K | Fe K |
|---|---|---|---|---|---|---|---|---|---|---|
| Area 1 (Matrix) | 4.47 | 2.2 | 57.45 | 1.47 | 0.82 | 0.78 | 2.4 | 1.78 | 21.33 | 7.32 |
| Spot 1 | 15.89 | 2.53 | 3.54 | 0.37 | 1.72 | 37.63 | 2.47 | 35.12 | 0.71 | 0.02 |
| Spot 2 | 14.93 | 2.19 | 10.69 | 0.64 | 1.36 | 31.44 | 2.22 | 30.89 | 4.38 | 1.27 |
| Spot 3 | 16.2 | 3.64 | 14.03 | 0.61 | 1.54 | 28.52 | 3.32 | 19.52 | 11.35 | 1.27 |
| Spot 4 | 19.76 | 3.09 | 10.55 | 0.44 | 1.31 | 35.59 | 2.18 | 24.06 | 2.4 | 0.63 |
| Spot 5 | 19.51 | 2.95 | 31.26 | 1.31 | 1.49 | 17.35 | 1.86 | 11.66 | 9.4 | 3.21 |
| Spot 6 | 7.25 | 3.17 | 21.36 | 0.52 | 0.68 | 0.27 | 6.15 | 1.24 | 53.91 | 5.45 |
| Spot 7 | 6.41 | 3 | 22.21 | 0.46 | 1.22 | 0.25 | 5.84 | 0.66 | 55.92 | 4.03 |
| Spot 8 | 7.97 | 3.14 | 40.58 | 2.31 | 1.59 | 1.16 | 4.42 | 1.76 | 35.49 | 1.58 |
| Spot 9 | 6.88 | 2.82 | 15.51 | 0.26 | 1.28 | 0.14 | 6.81 | 0.12 | 64.67 | 1.5 |
| Spot 10 | 12.14 | 2.71 | 45.4 | 1.44 | 1.26 | 8.81 | 2.22 | 5.84 | 14.87 | 5.31 |

HIGH STRENGTH THERMALLY STABLE NICKEL-BASE ALLOYS

CROSS-REFERENCE TO RELATED APPLICATIONS

This application claims priority to and the benefit of U.S. patent application Ser. No. 63/136,668, filed on Jan. 13, 2021. The disclosure of the above application is incorporated herein by reference.

FIELD

The present disclosure relates to nickel-base alloys, and particularly to high strength thermally stable nickel-base alloys for use at elevated temperatures.

BACKGROUND

The statements in this section merely provide background information related to the present disclosure and may not constitute prior art.

Alloys for use in harsh environments such as advanced ultra-supercritical (A-USC) boilers require a combination of ductility at room temperature for fabricability, and strength and oxidation resistance at temperatures approaching 815° C. (1500° F.) while in service. Accordingly, traditional alloys have used a combination of nickel and chromium for high temperature oxidation resistance, titanium, aluminum, and niobium for high temperature strength via precipitation hardening, and nickel and cobalt for ductility at room temperature and after use of the alloy at elevated temperatures such that fabrication and repair of the alloy is provided.

The present disclosure addresses the issue of alloys with desired strength and ductility for use in A-USC boilers and other issues related to nickel-base precipitation hardenable alloys for use in high temperature corrosion environments.

SUMMARY

This section provides a general summary of the disclosure and is not a comprehensive disclosure of its full scope or all of its features.

In one form of the present disclosure, an alloy includes a composition, in weight percent (weight percent is used throughout unless otherwise indicated), of aluminum from about 1.3% to about 1.8%, cobalt from about 1.5% to about 4.0%, chromium from about 18.0% to about 22.0%, iron from about 4.0% to about 10.0%, molybdenum from about 1.0% to about 3.0%, niobium from about 1.0% to about 2.5%, titanium from about 1.3% to about 1.8%, tungsten from about 0.8% to about 1.2%, carbon from about 0.01% to about 0.08%, and balance nickel and incidental impurities. In some variations, the alloy has a stress rupture life at 700° C. and 393.7 MPa (57.1 ksi) of at least 300 hours and a room temperature percent elongation of at least 15% after aging at 700° C. for 1,000 hours.

In some variations, the cobalt content in the alloy is from about 2.0% to about 3.0%. In at least one variation the molybdenum content in the alloy is from about 1.0% to about 2.75%. In some variations, the niobium content in the alloy is from about 1.0% to about 1.75%.

In at least one variation, the cobalt content in the alloy is from about 2.0% to about 3.0% and the molybdenum content in the alloy is from about 1.0% to about 2.75%. In some variations, the cobalt content in the alloy is from about 2.0% to about 3.0% and the niobium content in the alloy is from about 1.0% to about 1.75%.

In at least one variation, the molybdenum content in the alloy is from about 1.0% to about 2.75% and the niobium content in the alloy is from about 1.0% to about 1.75%.

In some variations, the cobalt content in the alloy from about 2.0% to about 3.0%, the molybdenum content in the alloy from about 1.0% to about 2.75%, and the niobium content in the alloy from about 1.0% to about 1.75%.

In at least one variation the stress rupture life of the alloy at 700° C. and 393.7 MPa (57.1 ksi) is at least 500 hours.

In some variations, the room temperature percent elongation of the alloy is at least 20% after aging at 700° C. for 1,000 hours. In at least one variation, the room temperature percent elongation of the alloy is at least 22% after aging at 700° C. for 1,000 hours.

In at least one variation the alloy has a room temperature percent elongation of at least 15% after aging at 700° C. for 5,000 hours. In some variations, the alloy has a room temperature percent elongation of at least 20% after aging at 700° C. for 5,000 hours.

In some variations, the alloy has a room temperature impact energy of at least 12 ft-lb after aging at 700° C. for 1,000 hours. In at least one variation the alloy has a room temperature impact energy of at least 15 ft-lb after aging the at 700° C. for 1,000 hours, and in some variations the alloy has a room temperature impact energy of at least 20 ft-lb after aging the at 700° C. for 1,000 hours.

In at least one variation, the alloy has a room temperature impact energy of at least 10 ft-lb after aging at 700° C. for 5,000 hours. In some variations, the alloy has a room temperature impact energy of at least 12 ft-lb after aging at 700° C. for 5,000 hours, and in at least one variation the alloy has a room temperature impact energy of at least 15 ft-lb after aging at 700° C. for 5,000 hours.

In some variations, the alloy has a room temperature (RT) ultimate tensile strength between about 160 ksi (1104 MPa) and about 175 ksi (1207 MPa), a RT 0.2% yield strength between about 95 ksi (655 MPa) and 115 ksi (793 MPa), and a RT percent elongation between about 30% and 45%, after annealing the alloy at 788° C. (1450° F.) for 4 hours followed by air cooling. And in at least one variation, the RT ultimate tensile strength is between about 160 ksi (1104 MPa) and about 170 ksi (1172 MPa), the RT 0.2% yield strength is between about 95 ksi (655 MPa) and 110 ksi (758 MPa), and the RT percent elongation is between about 35% and 45%, after annealing the alloy at 788° C. (1450° F.) for 4 hours followed by air cooling.

In some variations, the alloy has a room temperature (RT) ultimate tensile strength between about 175 ksi (1207 MPa) and about 195 ksi (1344 MPa), a RT 0.2% yield strength between about 105 ksi (724 MPa) and 125 ksi (861 MPa), and a RT percent elongation between about 15% and 30%, after annealing the alloy at 788° C. (1450° F.) for 4 hours followed by air cooling and aging the alloy at 700° C. (1292° F.) for 1,000 hours followed by air cooling. And in at least one variation, the RT ultimate tensile strength is between about 175 ksi (1207 MPa) and about 185 ksi (1275 MPa), the RT 0.2% yield strength is between about 105 ksi (724 MPa) and 120 ksi (827 MPa), and the RT percent elongation is between about 22% and 30%, after annealing the alloy at 788° C. (1450° F.) for 4 hours followed by air cooling and aging the alloy at 700° C. (1292° F.) for 1,000 hours followed by air cooling.

In some variations, the alloy has a RT ultimate tensile strength between about 170 ksi (1172 MPa) and about 200 ksi (1379 MPa), a RT 0.2% yield strength between about 100 ksi (689 MPa) and about 120 ksi (827 MPa), and a RT percent elongation between about 16% and 30%, after annealing the alloy at 788° C. (1450° F.) for 4 hours followed by air cooling and aging the alloy at 700° C. (1292° F.) for 5,000 hours followed by air cooling. And in at least one variation the RT ultimate tensile strength is between about 175 ksi (1207 MPa) and about 190 ksi (1310 MPa), the RT 0.2% yield strength is between about 105 ksi (724 MPa) and about 115 ksi (793 MPa), and the RT percent elongation is between about 20% and 30%, after annealing the alloy at 788° C. (1450° F.) for 4 hours followed by air cooling and aging the alloy at 700° C. (1292° F.) for 5,000 hours followed by air cooling.

In some variations, the alloy has a 700° C. ultimate tensile strength between about 130 ksi (896 MPa) and about 155 ksi (1069 MPa), a 700° C. 0.2% yield strength between about 90 ksi (620 MPa) and about 105 ksi (724 MPa), and a 700° C. percent elongation between about 9% and 25%, after annealing the alloy at 788° C. (1450° F.) for 4 hours followed by air cooling. And in at least one variation, the 700° C. ultimate tensile strength is between about 125 ksi (861 MPa) and about 140 ksi (965 MPa), the 700° C. 0.2% yield strength is between about 90 ksi (620 MPa) and 100 ksi (689 MPa), and the 700° C. percent elongation is between about 14% and 20%, after annealing the alloy at 788° C. (1450° F.) for 4 hours followed by air cooling.

In some variations, the alloy has a 700° C. ultimate tensile strength between about 135 ksi (931 MPa) and about 155 ksi (1069 MPa), a 700° C. 0.2% yield strength between about 95 ksi (655 MPa) and about 110 ksi (758 MPa), and a 700° C. percent elongation between about 12% and 30%, after annealing the alloy at 788° C. (1450° F.) for 4 hours followed by air cooling and aging the alloy at 700° C. (1292° F.) for 1,000 hours followed by air cooling. And in at least one variation, the 700° C. ultimate tensile strength is between about 135 ksi (931 MPa) and about 150 ksi (1034 MPa), the 700° C. 0.2% yield strength is between about 95 ksi (655 MPa) and 105 ksi (724 MPa), and the 700° C. percent elongation is between about 15% and 30%, after annealing the alloy at 788° C. (1450° F.) for 4 hours followed by air cooling and aging the alloy at 700° C. (1292° F.) for 1,000 hours followed by air cooling.

In some variations, the alloy has a 700° C. ultimate tensile strength between about 130 ksi (896 MPa) and about 150 ksi (1034 MPa), a 700° C. 0.2% yield strength between about 90 ksi (620 MPa) and about 110 ksi (758 MPa), and a 700° C. percent elongation between about 15% and 28%, after annealing the alloy at 788° C. (1450° F.) for 4 hours followed by air cooling and aging the alloy at 700° C. (1292° F.) for 5,000 hours followed by air cooling. And in at least one variation, the 700° C. ultimate tensile strength is between about 130 ksi (896 MPa) and about 145 ksi (1000 MPa), the 700° C. 0.2% yield strength is between about 90 ksi (620 MPa) and 102 ksi (703 MPa), and the 700° C. percent elongation is between about 15% and 25%, after annealing the alloy at 788° C. (1450° F.) for 4 hours followed by air cooling and aging the alloy at 700° C. (1292° F.) for 5,000 hours followed by air cooling.

In some variations, the alloy has a composition, in weight percent, that includes manganese from about 0.02% to about 0.3%, silicon from about 0.05% to about 0.3%, vanadium from about 0.005% to about 0.2%, zirconium from about 0.005% to about 0.2%, boron from about 0.001% to about 0.025%, and nitrogen from about 0.001% to about 0.02%.

In another form of the present disclosure, an alloy has a composition, in weight percent, consisting essentially of aluminum from about 1.3% to about 1.8%, boron from about 0.001% to about 0.025%, carbon from about 0.01% to about 0.05%, cobalt from about 2.0% to about 3.0%, chromium from about 18.0% to about 22.0%, iron from about 4.0% to about 10.0%, manganese from about 0.02% to about 0.3%, molybdenum from about 1.0% to about 3.0%, niobium from about 1.0% to about 2.5%, nitrogen from about 0.001% to about 0.02%, silicon from about 0.05% to about 0.3%, titanium from about 1.3% to about 1.8%, tungsten from about 0.8% to about 1.2%, vanadium from about 0.005% to about 0.2%, zirconium from about 0.005% to about 0.2%, and balance nickel and incidental impurities. In some variations, the alloy has a stress rupture life at 700° C. and 393.7 MPa (57.1 ksi) of at least 300 hours and a room temperature percent elongation of at least 15% after aging at 700° C. for 1,000 hours.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
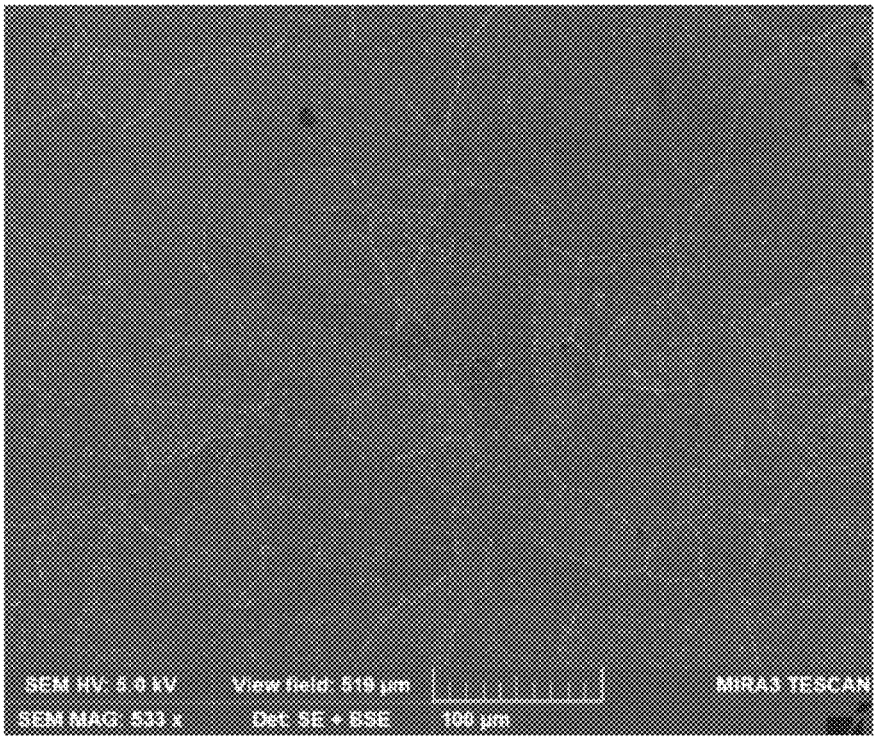
FIG. 1 shows an SEM micrograph depicting a microstructure of a high strength thermally stable nickel-base alloy according to the teachings of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features. It should be understood that compositional values in the present application are expressed in weight percent ("wt. %" or simply "%" hereafter) unless otherwise stated.

Referring to Table 1, compositions for eighteen (18) experimental heats (Heats 1-18) and one heat (Heat 19) of a commercial alloy are shown. The commercial alloy heat is for the INCONEL® brand nickel-chromium brand alloy, and more specifically, the 740H® brand (hereinafter referred to as "Alloy 740H"). Referring to Table 2, three additional experimental heats (Heats 20-22) are shown.

The experimental alloys include a range of carbon (C), iron (Fe), silicon (Si), nickel (Ni), chromium (Cr), aluminum (Al), titanium (Ti), cobalt (Co), molybdenum (Mo), niobium (Nb), and tungsten (W). In addition, small amounts (i.e., less than about 0.10 wt. %) of manganese (Mn), sulfur (S), copper (Cu), tantalum (Ta), phosphor (P), boron (B), vanadium (V), and zirconium (Zr) are included as impurities, trace elements, de-oxidizing elements, and/or grain boundary strengthening additions as discussed in greater detail below. Further, calcium (Ca), magnesium (Mg), and rare earth metals such as cesium, lanthanum, yttrium and the like may be present as trace elements with desulfurizing and deoxidizing properties.

TABLE 1

| | Weight % | | | | | | | | | | |
|---|---|---|---|---|---|---|---|---|---|---|---|
| HEAT | C | MN | FE | S | SI | CU | NI | CR | AL | TI | CO |
| Heat 1 | 0.013 | 0.09 | 4.09 | 0.0015 | 0.15 | 0.01 | 66.89 | 20.02 | 1.76 | 1.87 | 0.03 |
| Heat 2 | 0.012 | 0.09 | 4.11 | 0.0014 | 0.16 | 0.01 | 64.62 | 19.64 | 1.70 | 1.74 | 2.82 |
| Heat 3 | 0.015 | 0.09 | 4.10 | 0.0019 | 0.15 | 0.01 | 66.59 | 20.09 | 1.65 | 1.70 | 0.08 |
| Heat 4 | 0.014 | 0.09 | 4.10 | 0.0019 | 0.16 | 0.01 | 66.36 | 19.97 | 1.59 | 1.59 | 0.04 |
| Heat 5 | 0.014 | 0.10 | 5.96 | 0.0019 | 0.16 | 0.01 | 62.55 | 19.91 | 1.66 | 1.76 | 2.77 |
| Heat 6 | 0.015 | 0.10 | 6.90 | 0.0016 | 0.16 | 0.01 | 61.38 | 19.63 | 1.56 | 1.62 | 2.90 |
| Heat 7 | 0.013 | 0.10 | 7.01 | 0.0016 | 0.13 | 0.01 | 61.21 | 19.65 | 1.65 | 1.62 | 2.94 |
| Heat 8 | 0.014 | 0.10 | 7.99 | 0.0016 | 0.15 | 0.01 | 63.17 | 19.91 | 1.68 | 1.66 | 0.22 |
| Heat 9 | 0.018 | 0.10 | 3.05 | 0.0025 | 0.12 | 0.01 | 67.60 | 19.86 | 1.62 | 1.65 | 0.03 |
| Heat 10 | 0.019 | 0.11 | 6.74 | 0.0020 | 0.12 | 0.01 | 63.08 | 19.26 | 1.52 | 1.54 | 1.81 |
| Heat 11 | 0.018 | 0.10 | 8.46 | 0.0022 | 0.13 | 0.01 | 63.71 | 19.53 | 1.52 | 1.56 | 0.13 |
| Heat 12 | 0.019 | 0.10 | 5.22 | 0.0022 | 0.12 | 0.01 | 63.89 | 19.72 | 1.53 | 1.54 | 1.84 |
| Heat 13 | 0.02 | 0.09 | 8.69 | 0.0019 | 0.13 | 0.01 | 62.10 | 19.25 | 1.41 | 1.82 | 1.94 |
| Heat 14 | 0.015 | 0.09 | 9.86 | 0.0021 | 0.12 | 0.01 | 60.68 | 19.21 | 1.36 | 1.78 | 1.95 |
| Heat 15 | 0.015 | 0.10 | 11.87 | 0.0004 | 0.13 | 0.01 | 56.54 | 19.63 | 1.65 | 1.62 | 2.94 |
| Heat 16 | 0.013 | 0.10 | 13.80 | 0.0002 | 0.13 | 0.01 | 54.44 | 19.70 | 1.67 | 1.63 | 2.95 |
| Heat 17 | 0.019 | 0.08 | 11.80 | 0.0010 | 0.13 | 0.01 | 56.66 | 19.56 | 1.54 | 1.49 | 1.95 |
| Heat 18 | 0.02 | 0.09 | 13.65 | 0.0013 | 0.13 | 0.01 | 54.62 | 19.50 | 1.53 | 1.50 | 1.94 |
| Heat 19 | 0.035 | 0.29 | 0.19 | 0.0008 | 0.15 | 0.01 | 49.73 | 24.50 | 1.39 | 1.45 | 20.07 |

| | Weight % | | | | | | | | | Ti/Al |
|---|---|---|---|---|---|---|---|---|---|---|
| HEAT | MO | NB | TA | P | B | V | W | ZR | Ti/Al | Atomic % |
| Heat 1 | 2.99 | 1.00 | 0.006 | 0.0039 | 0.0032 | 0.019 | 1.02 | 0.016 | 1.06 | 0.60 |
| Heat 2 | 2.99 | 1.01 | 0.008 | 0.0043 | 0.0031 | 0.020 | 1.02 | 0.015 | 1.02 | 0.58 |
| Heat 3 | 2.95 | 1.48 | 0.009 | 0.0036 | 0.0031 | 0.018 | 1.01 | 0.015 | 1.03 | 0.58 |
| Heat 4 | 3.00 | 1.98 | 0.009 | 0.0036 | 0.0030 | 0.019 | 1.02 | 0.015 | 1.00 | 0.56 |
| Heat 5 | 2.96 | 1.06 | 0.007 | 0.0037 | 0.0035 | 0.018 | 1.02 | 0.015 | 1.06 | 0.60 |
| Heat 6 | 2.98 | 1.48 | 0.008 | 0.0037 | 0.0034 | 0.018 | 0.99 | 0.014 | 1.04 | 0.58 |
| Heat 7 | 3.00 | 1.50 | 0.013 | 0.0040 | 0.0035 | 0.013 | 0.93 | 0.010 | 0.98 | 0.55 |
| Heat 8 | 2.96 | 1.05 | 0.007 | 0.0037 | 0.0035 | 0.016 | 1.01 | 0.014 | 0.99 | 0.56 |
| Heat 9 | 2.32 | 2.62 | 0.012 | 0.0042 | 0.0027 | 0.015 | 0.92 | 0.011 | 1.02 | 0.57 |
| Heat 10 | 1.98 | 2.76 | 0.011 | 0.0040 | 0.0036 | 0.018 | 0.96 | 0.016 | 1.02 | 0.57 |
| Heat 11 | 1.05 | 2.66 | 0.011 | 0.0036 | 0.0016 | 0.017 | 0.94 | 0.013 | 1.02 | 0.58 |
| Heat 12 | 2.18 | 2.85 | 0.010 | 0.0039 | 0.0029 | 0.018 | 0.92 | 0.005 | 1.01 | 0.57 |
| Heat 13 | 1.45 | 2.00 | 0.012 | 0.0040 | 0.0013 | 0.017 | 0.94 | 0.011 | 1.29 | 0.73 |
| Heat 14 | 1.95 | 1.96 | 0.009 | 0.0040 | 0.0029 | 0.019 | 0.94 | 0.011 | 1.31 | 0.74 |
| Heat 15 | 2.99 | 1.50 | 0.012 | 0.0040 | 0.0032 | 0.015 | 0.93 | 0.011 | 0.98 | 0.55 |
| Heat 16 | 2.99 | 1.55 | 0.012 | 0.0039 | 0.0039 | 0.013 | 0.94 | 0.011 | 0.97 | 0.55 |
| Heat 17 | 2.24 | 2.87 | 0.011 | 0.0042 | 0.0033 | 0.014 | 0.95 | 0.012 | 0.97 | 0.55 |
| Heat 18 | 2.22 | 2.89 | 0.013 | 0.0042 | 0.0034 | 0.012 | 0.94 | 0.012 | 0.98 | 0.55 |
| Heat 19 | 0.49 | 1.46 | 0.010 | 0.0080 | 0.0013 | 0.008 | 0.05 | 0.030 | 1.04 | 0.59 |

TABLE 2

| | Weight % | | | | | | | | | | |
|---|---|---|---|---|---|---|---|---|---|---|---|
| HEAT | C | Mn | Fe | S | Si | Cu | Ni | Cr | Al | Ti | Co |
| Heat 20 | 0.07 | 0.1 | 7 | 0.0015 | 0.13 | 0.01 | 61.89 | 19.8 | 1.73 | 1.67 | 2.95 |
| Heat 21 | 0.04 | 0.09 | 7.02 | 0.0014 | 0.13 | 0.01 | 62.04 | 19.8 | 1.57 | 1.66 | 2.94 |
| Heat 22 | 0.02 | 0.09 | 6.99 | 0.0017 | 0.12 | 0.01 | 62.38 | 19.7 | 1.5 | 1.53 | 2.93 |

| | Weight % | | | | | | | | | Ti/Al |
|---|---|---|---|---|---|---|---|---|---|---|
| HEAT | Mo | Nb | Ta | P | B | V | W | Zr | Ti/Al | Atomic % |
| Heat 20 | 1.97 | 1.74 | 0.01 | 0.001 | 0.0031 | 0.02 | 0.94 | 0 | 1.04 | 0.58 |
| Heat 21 | 1.97 | 1.76 | 0.01 | 0.001 | 0.003 | 0.02 | 0.94 | 0 | 0.95 | 0.6 |
| Heat 22 | 1.97 | 1.76 | 0.01 | 0.001 | 0.0029 | 0.02 | 0.95 | 0.01 | 0.98 | 0.54 |

Carbon (C) is added for controlling grain growth during processing and enhancing creep strength. In excessive amounts, grain boundary carbides can compromise ductility of alloys in the present disclosure. Also, primary MC type carbides forming with niobium and titanium can form voluminous stringers, and also affect the amount of gamma prime strengthening phase that can form. Accordingly, the amount of C is between about 0.005% and about 0.1%. In some variations, the amount of C in the alloy is between about 0.0075% and about 0.075%, for example between about 0.01% and about 0.075%. In at least one variation, the amount of C in the alloy is between about 0.01% and about 0.05%.

Manganese (Mn) is added as a de-oxidizer. However, in excessive amounts, Mn can compromise thermal stability and ductility of alloys of the present disclosure. Accordingly, the amount of Mn is between about 0.05% and about 0.3%. In some variations, the amount of Mn in the alloy is between about 0.075% and about 0.25%, for example between about 0.075% and about 0.2%. In at least one variation, the amount of Mn in the alloy is between about 0.09% and about 0.15%.

Iron (Fe) is added to reduce the cost of production of the alloy. However, excessive Fe additions can compromise thermal stability and ductility of alloys of the present disclosure. Accordingly, the amount of Fe is between about 3.0% and about 15.0%. In some variations, the amount of Fe in the alloy is between about 4.0% and about 12.5%, for example between about 4.0% and about 10.0%. In at least one variation, the amount of Fe in the alloy is between about 4.0 and about 9.0%, for example between about 5.0 and about 10.0%.

Similar to Mn, silicon (Si) is added as a de-oxidizer. However, in excessive amounts, Si can compromise weldability, and thermal stability and ductility of alloys of the present disclosure. Accordingly, the amount of Si is between about 0.05% and about 0.3%. In some variations, the amount of Si in the alloy is between about 0.075% and about 0.25%, for example between about 0.1% and about 0.2%. In at least one variation, the amount of Si in the alloy is between about 0.11% and about 0.18%.

Nickel (Ni) improves metallurgical stability, high temperature corrosion resistance and weldability. Also, nickel is provided for the formation of the gamma prime strengthening phase.

Chromium (Cr) is added to enhance the elevated-temperature corrosion resistance. However, excessive Cr additions can compromise high temperature strength and promote formation of the deleterious sigma phase in alloys of the present disclosure. Accordingly, the amount of Cr is between about 17.0% and about 23.0%. In some variations, the amount of Cr in the alloy is between about 18.0% and about 22.0%, for example between about 19.0% and about 21.0%.

Aluminum (Al) is added for forming the $Ni_3Al$ gamma prime phase. However, excessive Al additions can compromise hot formability for alloys of the present disclosure. Accordingly, the amount of Al is between about 1.0% and about 2.5%. In some variations, the amount of Al in the alloy is between about 1.1% and about 2.0%, for example between about 1.3% and about 1.9%. In at least one variation, the amount of Al in the alloy is between about 1.2% and about 1.8%, for example between about 1.3 and about 1.9%.

Titanium (Ti) is also added for forming the gamma prime phase and can substitute for Al. However, excessive Ti additions can compromise hot formability for alloys of the present disclosure. Accordingly, the amount of Ti is between about 1.0% and about 2.5%. In some variations, the amount of Ti in the alloy is between about 1.1% and about 2.0%, for example between about 1.3% and about 1.9%. In at least one variation, the amount of Ti in the alloy is between about 1.2 and about 1.8%, for example between about 1.3 and about 1.9%.

Cobalt (Co) enhances elevated-temperature strength and correlates with improved rupture ductility. However, excessive Co additions increases the cost of alloys of the present disclosure. Accordingly, the amount of Co is between about 1.0% and about 3.0%. In some variations, the amount of Co in the alloy is between about 1.5% and about 3.0%, for example between about 1.6% and about 3.0%. In at least one variation, the amount of Co in the alloy is between about 1.7 and about 3.0%, for example between about 1.8% and about 3.0%.

Molybdenum (Mo) provides a solid solution strengthening effect thereby enhancing elevated-temperature rupture strength. However, excessive Mo additions can result in formation of topologically closed packed (TCP) phases which can compromise ductility of alloys of the present disclosure after long-term exposure to elevated temperatures. Accordingly, the amount of Mo is between about 0.8% and about 3.5%. In some variations, the amount of Mo in the alloy is between about 1.0% and about 3.0%, for example between about 1.0% and about 2.9%. In at least one variation, the amount of Mo in the alloy is between about 1.0 and about 2.8%, for example between about 1.0% and about 2.7%.

Niobium (Nb) is added for solid solution strengthening and can substitute for Al in the gamma prime phase. However, excessive Nb additions can compromise hot formability, and ductility and impact strength of alloys of the present disclosure after long-term exposure to elevated temperatures. Accordingly, the amount of Nb is between about 1.0% and about 3.0%. In some variations, the amount of Nb in the alloy is between about 1.0% and about 2.8%, for example between about 1.0% and about 2.7. In at least one variation, the amount of Nb in the alloy is between about 1.0% and about 2.6%, for between about 1.2 and about 2.7%. It should be understood that in some variations of the present disclosure tantalum (Ta) is substituted for some or all of the Nb. For example, in at least one variation Nb is less than 1.0% and Ta is added up to 1.0%.

Boron (B) and zirconium (Zr) additions provide grain boundary strengthening and improve high temperature ductility. However, excessive B and/or Zr additions can compromise hot formability and weldability of alloys in the present disclosure. Accordingly, the amount of B is between about 0.001% and about 0.025%. In some variations, the amount of B in the alloy is between about 0.002% and about 0.02%, for example between about 0.003% and about 0.015%. In at least one variation, the amount of B is between about 0.003% and about 0.01%. Also, the amount of Zr is between about 0.001% and about 0.05%. In some variations, the amount of Zr in the alloy is between about 0.005% and about 0.04%, for example between about 0.0075% and about 0.03%. In at least one variation, the amount of Zr is between about 0.01 and about 0.02%.

Similar to Mo, tungsten (W) provides a solid solution strengthening effect and thereby enhances elevated-temperature rupture strength. However, excessive W additions can result in formation of TCP (topologically close pack) phases which can compromise of alloys of the present disclosure after long-term exposure to elevated temperatures. Accordingly, the amount of W is between about 0.75% and about 2.0%. In some variations, the amount of W in the alloy is between about 0.8% and about 1.5%, for example between about 0.9% and about 1.3%. In at least one variation, the amount of W in the alloy is between about 0.9 and about 1.2%, for example between about 0.8% and about 1.2%.

It should also be understood that the elemental ranges discussed herein include all incremental values between the minimum alloying element composition and maximum alloying element composition values. That is, a minimum alloying element composition value can range from the minimum value to the maximum value. Likewise, the maximum alloying element composition value can range from the maximum value shown to the minimum value discussed. For example, the minimum Ti content can be 1.0, 1.1, 1.2, 1.3, 1.4, 1.5, 1.6, 1.7, 1.8, 1.9, 2.0, 2.1, 2.2, 2.3, 2.4, 2.5, and any value between these incremental values, and the maximum Ti content can be 2.5, 2.4, 2.3, 2.2, 2.1, 2.0, 1.9, 1.8, 1.7, 1.6, 1.5, 1.4, 1.3, 1.2, 1.1, 1.0, and any value between these incremental values.

Still referring to Tables 1 and 2, Heats 2, 5, 6, 7, 10, 12, and 20-22 are examples of compositions according to the teachings of the present disclosure. Particularly, Heats 2, 5, 6, 7, 10, 12, and 20-22 have a chemical composition within the teachings of the present disclosure. In addition, Heats 2, 5, 6, 7, 10, 12, and 20-22 have at least one desired property with respect to cost, mechanical strength, ductility, thermal stability, and/or high temperature corrosion.

In some variations of the present disclosure, alloys according to the teachings of the present disclosure have a combination of desired properties with respect to cost, mechanical strength, ductility and/or high temperature corrosion as discussed in greater detail below.

Heats of the experimental alloys were melted in a vacuum induction melting (VIM) furnace and cast into 4 inch (10.2 cm) diameter molds to form 50 pound (22.7 kg) ingots. The ingots were heated for 16 hours at 2200° F. (1204° C.), after which the temperature was lowered to 2100° F. (1149° C.) for initial hot-rolling with re-heats at 2075° F. (1135° C.) for additional hot rolling until 0.5 inch (1.27 cm) thick hot-rolled plate was produced. The 0.5 inch (1.27 cm) thick hot-rolled plate was "solution annealed" at 2000° F. (1093° C.) for 1 hour followed by water quenching and then "aged" at 1450° F. (788° C.) for 4 hours followed by air cooling. All experimental heat samples examined in this "solution annealed+aged" condition had a grain size of ASTM #2-4.

The commercial alloy heat (i.e., Heat 19) was initially hot rolled at 2100° F. (1149° C.) from 1.5 inch (3.8 cm) commercial plate with 2075° F. (1135° C.) re-heats in processing the material to 0.5 inch (1.27 cm) thick hot-rolled plate. The 0.5 inch (1.27 cm) thick hot-rolled plate of Heat 19 solution annealed at 2025° F. (1107° C.) for 1 hour followed by water quenching and aged at 1472° F. (800° C.) for 4 hours followed by air cooling. All commercial alloy heat samples examined in this solution annealed+aged condition also has had a grain size of ASTM #2-4.

In addition to samples of the heats shown in Tables 1 and 2 provided (and tested) in the solution annealed+aged condition described above, some solution annealed+aged samples were subjected to additional aging at 700° C. (1292° F.) for 1,000 hours ("700° C./1,000 h/AC") followed by air cooling or additional aging at 700° C. (1292° F.) for 5,000 hours (("700° C./5,000 h/AC") followed by air cooling. Accordingly, samples were tested in the solution annealed+aged condition, in the solution annealed+aged+700° C./1,000 h/AC condition (also referred to herein simply as the "700° C./1,000 h/AC condition" or the "700° C./1,000 h/AC sample(s)"), and in the solution annealed+aged+700° C./5,000 h/AC condition (also referred to herein simply as the "700° C./5,000 h/AC condition" or the "700° C./5,000 h/AC sample(s)").

Referring to Tables 3 and 4, room temperature (RT) tensile data are shown for samples tested in the solution annealed+aged condition.

TABLE 3

| Heat | UTS, ksi | UTS, MPa | YS, ksi | YS, MPa | Elong. | ROA |
|---|---|---|---|---|---|---|
| Alloy 1 | 164.7 | 1135.6 | 103.3 | 712.3 | 37.6 | 41.9 |
| Alloy 2 | 162.8 | 1122.5 | 103.4 | 712.9 | 40 | 41.6 |
| Alloy 3 | 165.1 | 1138.4 | 104.3 | 719.1 | 38.1 | 41.8 |

TABLE 3-continued

| Heat | UTS, ksi | UTS, MPa | YS, ksi | YS, MPa | Elong. | ROA |
|---|---|---|---|---|---|---|
| Alloy 4 | 166.9 | 1150.8 | 106.9 | 737.1 | 38.6 | 43.6 |
| Alloy 5 | 160.8 | 1108.7 | 98.7 | 680.5 | 40.9 | 42.6 |
| Alloy 6 | 163.1 | 1124.6 | 101.4 | 699.2 | 39.3 | 42.1 |
| Alloy 7 | 169.3 | 1167.3 | 102.7 | 708.1 | 35 | 37 |
| Alloy 7 | 167.8 | 1157.0 | 99.8 | 688.1 | 36 | 41 |
| Alloy 8 | 165.4 | 1140.4 | 103.8 | 715.7 | 36.8 | 41.8 |
| Alloy 9 | 171.8 | 1184.6 | 110.3 | 760.5 | 31 | 28 |
| Alloy 10 | 171.4 | 1181.8 | 109.4 | 754.3 | 35 | 38 |
| Alloy 11 | 171.9 | 1185.3 | 107 | 737.8 | 33 | 41 |
| Alloy 12 | 170.1 | 1172.8 | 107.8 | 743.3 | 35 | 39 |
| Alloy 13 | 172.6 | 1190.1 | 106.1 | 731.6 | 34 | 40 |
| Alloy 14 | 169.7 | 1170.1 | 104.2 | 718.5 | 34 | 40 |
| Alloy 15 | 164.3 | 1132.8 | 95.1 | 655.7 | 40 | 46 |
| Alloy 15 | 166.2 | 1145.9 | 97.5 | 672.3 | 39 | 42 |
| Alloy 16 | 166.4 | 1147.3 | 98.2 | 677.1 | 37 | 43 |
| Alloy 17 | 176.6 | 1217.7 | 109.3 | 753.6 | 33 | 39 |
| Alloy 18 | 172.2 | 1187.3 | 105.5 | 727.4 | 27 | 29 |
| Alloy 18 | 174 | 1199.7 | 105.2 | 725.4 | 35 | 37 |
| Alloy 19 | 167.5 | 1154.9 | 103.6 | 714.3 | 37 | 45 |

TABLE 4

| Heat | UTS, ksi | UTS, Mpa | YS, ksi | YS, Mpa | Elong. | ROA |
|---|---|---|---|---|---|---|
| Heat 22 | 171.8 | 1184.6 | 109.5 | 755.0 | 33.9 | 41.7 |
| Heat 22 | 170.9 | 1178.4 | 109.7 | 756.4 | 34 | 40.7 |
| Heat 21 | 167.8 | 1157 | 102.3 | 705.4 | 34.8 | 40.7 |
| Heat 21 | 167.5 | 1154.7 | 103.5 | 713.6 | 38.4 | 45.3 |
| Heat 20 | 164.2 | 1132.2 | 102.1 | 703.8 | 38.4 | 44 |
| Heat 20 | 165.6 | 1142.1 | 103.2 | 711.5 | 38.4 | 45.3 |

As shown in Tables 3 and 4, the heats with compositions within the teachings of the present disclosure (i.e., Heats 2, 5, 6, 7, 10, 12, and 20-21) have a minimum RT ultimate tensile strength (UTS) of 1108.7 megapascals (MPa) (160.8 kilopounds per square inch (ksi)), a minimum RT 0.2% yield strength (YS) of 680.5 MPa (98.7 ksi), a minimum RT percent elongation of 35%, and a minimum RT percent reduction of area (ROA) of 37%. That is, in some variations, alloys with compositions within the teachings of the present disclosure in the solution anneal+aged condition have a minimum RT UTS of 1108.7 MPa (160.8 ksi), a minimum RT YS of 680.5 MPa (98.7 ksi), a minimum RT percent elongation of 35%, and minimum RT ROA of 37%. In contrast, Heat 9 solution annealed+aged condition has a RT percent elongation of 31% and a RT ROA of 28%, Heat 11 in the solution annealed+aged condition has a RT percent elongation of 33%, Heat 13 in the solution annealed+aged condition has a RT percent elongation of 34%, and Heat 17 in the solution annealed+aged condition has a RT percent elongation of 33%.

In addition, the commercial alloy Heat 19 has a RT UTS of 1154.9 MPa (167.5 ksi), a RT 0.2% YS of 714.3 MPa (103.6 ksi), a RT percent elongation of 37%, and a RT percent ROA of 45%. Accordingly, the alloys with compositions within the teachings of the present disclosure in the solution anneal+aged condition have a RT UTS equal to about 0.96 the RT UTS of Alloy 740H, a RT YS equal to about 0.95 the RT YS of Alloy 740H, a RT percent elongation equal to about 0.95 the RT percent elongation of Alloy 740H, and a RT ROA equal to about 0.82 the RT ROA of Alloy 740H. Also, the alloys with compositions within the teachings of the present disclosure have a Co content that is only about 0.125 of the Co content in Alloy 740H.

Referring to Tables 5 and 6 below, RT tensile data are shown for samples tested in the 700° C./1,000 h/AC condition.

TABLE 5

| Heat | UTS, ksi | UTS, MPa | YS, ksi | YS, MPa | Elong, | ROA |
|---|---|---|---|---|---|---|
| Heat 1 | 179.5 | 1237.7 | 114.8 | 791.5 | 25 | 29 |
| Heat 2 | 175.7 | 1211.5 | 108.2 | 746.0 | 26 | 28 |
| Heat 3 | 183.4 | 1264.5 | 116.8 | 805.3 | 27 | 32 |
| Heat 4 | 181 | 1248.0 | 114.6 | 790.2 | 24 | 26 |
| Heat 5 | 176.2 | 1214.9 | 110.4 | 761.2 | 24 | 25 |
| Heat 6 | 179 | 1234.2 | 113.2 | 780.5 | 25 | 31 |
| Heat 8 | 176.9 | 1219.7 | 109.9 | 757.8 | 25 | 31 |
| Heat 9 | 181.8 | 1253.5 | 119.3 | 822.6 | 23 | 24 |
| Heat 10 | 184.8 | 1274.2 | 116.3 | 801.9 | 19 | 22 |
| Heat 11 | 184.1 | 1269.4 | 114.7 | 790.9 | 22 | 28 |
| Heat 12 | 186 | 1282.5 | 117.7 | 811.5 | 19 | 20 |
| Heat 13 | 185 | 1275.6 | 116.5 | 803.3 | 23 | 28 |
| Heat 14 | 182.7 | 1259.7 | 114.4 | 788.8 | 23 | 29 |
| Heat 15 | 177.3 | 1222.5 | 109.2 | 752.9 | 21.8 | 21.1 |
| Heat 15 | 176.5 | 1217.0 | 108.7 | 749.5 | 23.9 | 21.5 |
| Heat 16 | 182.1 | 1255.6 | 112.6 | 776.4 | 24.4 | 22.4 |
| Heat 16 | 180.6 | 1245.2 | 111.8 | 770.9 | 18.2 | 19.5 |
| Heat 17 | 189.9 | 1309.4 | 121.3 | 836.4 | 21.1 | 19.2 |
| Heat 17 | 187.8 | 1294.9 | 121.6 | 838.4 | 17.6 | 17.3 |
| Heat 18 | 188.6 | 1300.4 | 120.8 | 832.9 | 17.4 | 15.9 |
| Heat 18 | 188.6 | 1300.4 | 124.3 | 857.0 | 17.8 | 14.7 |
| Heat 7 | 180.7 | 1245.9 | 114.2 | 787.4 | 25.3 | 24.7 |
| Heat 7 | 180 | 1241.1 | 113.2 | 780.5 | 26.4 | 25.3 |
| Heat 19 | 181.2 | 1249.4 | 117.6 | 810.9 | 26 | 29 |

TABLE 6

| Heat | UTS, ksi | UTS, Mpa | YS, ksi | YS, Mpa | Elong. | ROA |
|---|---|---|---|---|---|---|
| Heat 22 | 184.0 | 1268.7 | 118.4 | 816.4 | 25.1 | 27.8 |
| Heat 22 | 183.9 | 1268.0 | 119.8 | 826.0 | 25.6 | 31.7 |
| Heat 21 | 182.5 | 1258.3 | 115.2 | 794.3 | 25.3 | 26.4 |
| Heat 21 | 181.8 | 1253.5 | 118.0 | 813.6 | 26.0 | 29.2 |
| Heat 20 | 181.4 | 1250.8 | 116.7 | 804.6 | 27.4 | 32.1 |
| Heat 20 | 181.3 | 1250.1 | 114.6 | 790.2 | 26.8 | 30.6 |

As shown in Tables 5 and 6, Heats 2, 5, 6, 7, 10, 12, and 20-21 have a minimum RT UTS of 1211.5 MPa (175.7 ksi), a minimum RT YS of 746 MPa (108.2 ksi), a minimum RT percent elongation of 19%, and a minimum RT ROA of 20%. That is, in some variations, alloys with compositions within the teachings of the present disclosure in the 700° C./1,000 h/AC condition have a minimum RT UTS of 1211.5 MPa (175.7 ksi), a minimum RT YS of 746 MPa (108.2 ksi), a minimum RT percent elongation of 19%, and minimum RT ROA of 19%. In contrast, Heats 16 and 18 in the 700° C./1,000 h/AC condition have a RT percent elongation less than 19% and Heats 16, 17, and 18 in the 700° C./1,000 h/AC condition have a RT ROA less than 20%. In addition, the commercial alloy Heat 19 in the 700° C./1,000 h/AC condition has a RT UTS of 1249.4 MPa (181.2 ksi), a RT 0.2% YS of 810.9 MPa (117.6 ksi), a RT percent elongation of 26%, and a RT percent ROA of 29%. Accordingly, the alloys with compositions within the teachings of the present disclosure in the in the 700° C./1,000 h/AC condition have a RT UTS equal to about 0.97 the RT UTS of Alloy 740H, a RT YS equal to about 0.92 the RT YS of Alloy 740H, a RT percent elongation equal to about 0.73 the RT percent elongation of Alloy 740H, and a RT ROA equal to about 0.69 the RT ROA of Alloy 740H.

Referring to Tables 7 and 8, RT tensile data are shown for samples in the 700° C./5,000 h/AC condition.

TABLE7

| Heat | UTS, ksi | UTS, MPa | YS, ksi | YS, MPa | Elong. | ROA |
|---|---|---|---|---|---|---|
| Heat 1 | 182.1 | 1255.6 | 109.9 | 757.8 | 23 | 21 |
| Heat 2 | 179.2 | 1235.6 | 106.2 | 732.2 | 25 | 27 |
| Heat 3 | 184.1 | 1269.4 | 112.6 | 776.4 | 24 | 26 |
| Heat 4 | 183.8 | 1267.3 | 110.2 | 759.8 | 23 | 22 |
| Heat 5 | 179.3 | 1236.3 | 106 | 730.9 | 23 | 25 |
| Heat 6 | 180.8 | 1246.6 | 108.6 | 748.8 | 24 | 26 |
| Heat 8 | 178.1 | 1228.0 | 106.9 | 737.1 | 24 | 29 |
| Heat 9 | 182 | 1254.9 | 112 | 772.2 | 20 | 19 |
| Heat 10 | 188 | 1296.3 | 114.2 | 787.4 | 19 | 21 |
| Heat 11 | 185.6 | 1279.7 | 111 | 765.3 | 21 | 22 |
| Heat 12 | 185.6 | 1279.7 | 117.7 | 811.5 | 17 | 18 |
| Heat 13 | 184.5 | 1272.1 | 113 | 779.1 | 22 | 28 |
| Heat 14 | 183.1 | 1262.5 | 111.6 | 769.5 | 21 | 24 |
| Heat 19 | 183.7 | 1266.6 | 110.1 | 759.1 | 26 | 30 |

TABLE 8

| Heat | UTS, ksi | UTS, Mpa | YS, ksi | YS, Mpa | Elong. | ROA |
|---|---|---|---|---|---|---|
| Heat 22 | 183.7 | 1266.6 | 116.3 | 801.9 | 21.8 | 21.7 |
| Heat 22 | 183.9 | 1268.0 | 114.8 | 791.5 | 23.1 | 21.4 |
| Heat 21 | 181.7 | 1252.8 | 111.1 | 766.0 | 22.2 | 22.9 |
| Heat 21 | 181.9 | 1254.2 | 109.6 | 755.7 | 21.3 | 20.2 |
| Heat 20 | 179.4 | 1237.0 | 108.0 | 744.7 | 24.1 | 22.7 |
| Heat 20 | 180.1 | 1241.8 | 115.4 | 795.7 | 25.4 | 27.6 |

As shown in Tables 7 and 8, Heats 2, 5, 6, 10, 12, and 20-22 (Heat 7 not tested) have a minimum RT UTS of 1235.6 MPa (179.2 ksi), a minimum RT YS of 730.9 MPa (106.0 ksi), a minimum RT percent elongation of 17%, and a minimum RT ROA of 18%. That is, in some variations, alloys with a composition within the teachings of the present disclosure in the 700° C./5,000 h/AC condition have a minimum RT UTS of 1235.6 MPa (179.2 ksi), a minimum RT YS of 730.9 MPa (106 ksi), a minimum RT percent elongation of 17%, and minimum RT ROA of 18%. In addition, the commercial alloy Heat 19 in the 700° C./5,000 h/AC condition has a RT UTS of 1266.6 MPa (183.7 ksi), a RT 0.2% YS of 759.1 MPa (110.1 ksi), a RT percent elongation of 26%, and a RT percent ROA of 30%. Accordingly, the alloys with compositions within the teachings of the present disclosure in the in the 700° C./5,000 h/AC condition have a RT UTS equal to about 0.98 the RT UTS of Alloy 740H, a RT YS equal to about 0.96 the RT YS of Alloy 740H, a RT percent elongation equal to about 0.65 the RT percent elongation of Alloy 740H, and a RT ROA equal to about 0.60 the RT ROA of Alloy 740H.

Referring to Tables 9 and 10, 700° C. (1292° F.) tensile data are shown for samples in the solution annealed+aged condition.

TABLE 9

| Heat | Temp., F. | Temp., C. | UTS, ksi | UTS, MPa | YS, ksi | YS, MPa | Elong. | ROA |
|---|---|---|---|---|---|---|---|---|
| Heat 1 | 1292 | 700 | 137.7 | 949.4 | 101.9 | 702.6 | 11.3 | 15.3 |
| Heat 2 | 1292 | 700 | 131.9 | 909.5 | 94.5 | 651.6 | 17.9 | 19.5 |
| Heat 3 | 1292 | 700 | 137.0 | 944.6 | 95.3 | 657.1 | 15.2 | 16.4 |

TABLE 9-continued

| Heat | Temp., F. | Temp., C. | UTS, ksi | UTS, MPa | YS, ksi | YS, MPa | Elong. | ROA |
|---|---|---|---|---|---|---|---|---|
| Heat 4 | 1292 | 700 | 140.2 | 966.7 | 99.5 | 686.1 | 17.6 | 21.1 |
| Heat 5 | 1292 | 700 | 134.5 | 927.4 | 94.2 | 649.5 | 16.7 | 21.3 |
| Heat 6 | 1292 | 700 | 136.9 | 943.9 | 94.9 | 654.3 | 20.2 | 24 |
| Heat 8 | 1292 | 700 | 139.0 | 958.4 | 97.6 | 673.0 | 17.5 | 18 |
| Heat 9 | 1292 | 700 | 149.8 | 1032.9 | 104.2 | 718.5 | 18 | 19.5 |
| Heat 10 | 1292 | 700 | 146.0 | 1006.7 | 101.8 | 701.9 | 23 | 26 |
| Heat 11 | 1292 | 700 | 135.0 | 930.8 | 101.4 | 699.2 | 9.5 | 9.5 |
| Heat 12 | 1292 | 700 | 146.3 | 1008.7 | 102.0 | 703.3 | 18.5 | 24 |
| Heat 13 | 1292 | 700 | 139.3 | 960.5 | 101.4 | 699.2 | 15 | 16.5 |
| Heat 14 | 1292 | 700 | 141.9 | 978.4 | 99.2 | 684.0 | 18.5 | 18 |
| Heat 15 | 1292 | 700 | 135.9 | 937.0 | 93.9 | 647.4 | 21.5 | 21 |
| Heat 15 | 1292 | 700 | 134.7 | 928.8 | 93.6 | 645.4 | 19.5 | 21.5 |
| Heat 16 | 1292 | 700 | 138.7 | 956.3 | 95.3 | 657.1 | 25 | 27.5 |
| Heat 16 | 1292 | 700 | 132.7 | 915.0 | 95.1 | 655.7 | 21.5 | 24.5 |
| Heat 17 | 1292 | 700 | 135.4 | 933.6 | 102.7 | 708.1 | 12.4 | 16.5 |
| Heat 17 | 1292 | 700 | 142.4 | 981.8 | 102.2 | 704.7 | 17 | 21.5 |
| Heat 18 | 1292 | 700 | 135 | 930.8 | 103 | 710.2 | 13 | 15 |
| Heat 18 | 1292 | 700 | 145.2 | 1001.2 | 103.5 | 713.6 | 17 | 21.5 |
| Heat 7 | 1292 | 700 | 140.5 | 968.7 | 97.4 | 671.6 | 24 | 25.5 |
| Heat 7 | 1292 | 700 | 139.6 | 962.5 | 97.4 | 671.6 | 23 | 24 |
| Heat 19 | 1292 | 700 | 139.3 | 960.5 | 91.4 | 630.2 | 29.5 | 30 |

TABLE 10

| Heat | Temp., F. | Temp., C. | UTS, ksi | UTS, Mpa | YS, ksi | YS, Mpa | Elong. | ROA |
|---|---|---|---|---|---|---|---|---|
| Heat 21 | 1292 | 700 | 141.2 | 973.6 | 101.2 | 697.4 | 14.1 | 17.7 |
| Heat 21 | 1292 | 700 | 133.7 | 921.9 | 100.6 | 693.6 | 12.5 | 6.1 |
| Heat 20 | 1292 | 700 | 135.0 | 930.8 | 99.7 | 687.4 | 17.8 | 20.1 |

As shown in Tables 9 and 10, the heats with compositions within the teachings of the present disclosure (i.e., Heats 2, 5, 6, 7, 10, 12, and 20-21) in the solution annealed+aged condition have a minimum 700° C. UTS of 909.5 MPa (131.9 ksi), a minimum 700° C. YS of 651.6 MPa (94.5 ksi), a minimum 700° C. percent elongation of 16.7%, and a minimum 700° C. percent reduction of area (ROA) of 19.5%. That is, in some variations of the present disclosure, alloys with a composition within the teachings of the present disclosure in the solution annealed+aged condition have a minimum 700° C. UTS of 909.5 MPa (131.9 ksi), a minimum 700° C. YS of 651.6 MPa (94.5 ksi), a minimum 700° C. percent elongation of 16.7%, and minimum 700° C. ROA of 19.5%. In contrast, Heat 1 in the solution annealed+aged condition has a 700° C. percent elongation of 11.3% and a 700° C. ROA of 15.3%, Heat 3 in the solution annealed+aged condition has a 700° C. percent elongation of 15.2% and a 700° C. ROA of 16.4%, Heat 11 in the solution annealed+aged condition has a 700° C. percent elongation and a 700° C. ROA of 9.5%, Heat 13 in the solution annealed+aged condition has a 700° C. percent elongation of 15.0% and a 700° C. ROA of 16.5%, Heat 17 in the solution annealed+aged condition has an average (of 2 samples) 700° C. percent elongation of 14.7% and a 700° C. ROA of 19.0%, and Heat 18 in the solution annealed+aged condition has an average (of 2 samples) 700° C. percent elongation of 15.0% and a 700° C. ROA of 18.3%.

In addition, the commercial alloy Heat 19 in the solution annealed+aged condition has a 700° C. UTS of 960.5 MPa (139.3 ksi), a 700° C. 0.2% YS of 630.2 MPa (91.4 ksi), a 700° C. percent elongation of 29.5%, and a 700° C. percent ROA of 30%. Accordingly, the alloys with compositions within the teachings of the present disclosure in the solution annealed+aged condition have a 700° C. UTS equal to about 0.95 the 700° C. UTS of Alloy 740H, a 700° C. YS equal to about 1.0 the 700° C. YS of Alloy 740H, a 700° C. percent elongation equal to about 0.57 the 700° C. percent elongation of Alloy 740H, and a 700° C. ROA equal to about 0.65 the 700° C. ROA of Alloy 740H.

Referring to Tables 11 and 12, 700° C. (1292° F.) tensile data are shown for samples in the 700° C./1,000 h/AC condition.

TABLE 11

| Heat | Temp., F. | Temp., C. | UTS, ksi | UTS, MPa | YS, ksi | YS, MPa | Elong. | ROA |
|---|---|---|---|---|---|---|---|---|
| Heat 1 | 1292 | 700 | 146.8 | 1012.2 | 103.6 | 714.3 | 23 | 26 |
| Heat 2 | 1292 | 700 | 148.1 | 1021.1 | 98.8 | 681.2 | 23.5 | 26 |
| Heat 3 | 1292 | 700 | 145.8 | 1005.3 | 102.6 | 707.4 | 22 | 27.5 |
| Heat 4 | 1292 | 700 | 149.4 | 1030.1 | 102.1 | 704.0 | 23 | 23 |
| Heat 5 | 1292 | 700 | 145.9 | 1006.0 | 99.2 | 684.0 | 26.5 | 30.5 |
| Heat 6 | 1292 | 700 | 151 | 1041.1 | 104.4 | 719.8 | 20.5 | 22 |
| Heat 8 | 1292 | 700 | 140.9 | 971.5 | 101.1 | 697.1 | 24.5 | 30 |
| Heat 9 | 1292 | 700 | 154.9 | 1068.0 | 108.2 | 746.0 | 20.5 | 24 |
| Heat 10 | 1292 | 700 | 154.5 | 1065.3 | 108.3 | 746.7 | 25.5 | 24.5 |
| Heat 11 | 1292 | 700 | 147 | 1013.6 | 105.3 | 726.0 | 15 | 16.5 |
| Heat 12 | 1292 | 700 | 142.7 | 983.9 | 100.2 | 690.9 | 28.5 | 35 |
| Heat 13 | 1292 | 700 | 143.6 | 990.1 | 106 | 730.9 | 23.5 | 25 |
| Heat 14 | 1292 | 700 | 141.1 | 972.9 | 104.1 | 717.8 | 21.5 | 29.5 |
| Heat 19 | 1292 | 700 | 143.2 | 987.4 | 99.6 | 686.7 | 25.5 | 31 |

TABLE 12

| Heat | Temp., F. | Temp., C. | UTS, ksi | UTS, Mpa | YS, ksi | YS, Mpa | Elong. | ROA |
|---|---|---|---|---|---|---|---|---|
| Heat 22 | 1292 | 700 | 140.9 | 971.5 | 106.9 | 737.1 | 24 | 24.7 |
| Heat 21 | 1292 | 700 | 140.5 | 968.7 | 106.7 | 735.7 | 26.5 | 28.8 |
| Heat 21 | 1292 | 700 | 137.4 | 947.4 | 101.2 | 697.8 | 20.4 | 28.7 |
| Heat 20 | 1292 | 700 | 147.5 | 1017.0 | 101.5 | 699.8 | 22.8 | 27.3 |

As shown in Tables 11 and 12, Heats 2, 5, 6, 10, 12, and 20-21 (Heat 7 not tested) in the 700° C./1,000 h/AC condition have a minimum 700° C. UTS of 983.9 MPa (142.7 ksi), a minimum 700° C. YS of 681.2 MPa (98.8 ksi), a minimum 700° C. percent elongation of 20.5%, and a minimum 700° C. ROA of 22.0%. That is, in some variations of the present disclosure, alloys with a composition within the teachings of the present disclosure in the 700° C./1,000 h/AC condition have a minimum 700° C. UTS of 983.9 MPa (142.7 ksi), a minimum 700° C. YS of 681.2 MPa (98.8 ksi), a minimum 700° C. percent elongation of 20.5%, and minimum 700° C. ROA of 22.0%. In contrast, Heat 11 in the 700° C./1,000 h/AC condition has a 700° C. percent elongation of 15.0% and a 700° C. ROA of 16.5%. In addition, the commercial alloy Heat 19 in the 700° C./1,000 h/AC condition has a 700° C. UTS of 987.4 MPa (143.2 ksi), a 700° C. 0.2% YS of 686.7 MPa (99.6 ksi), a 700° C. percent elongation of 25.5%, and a 700° C. percent ROA of 31%. Accordingly, the alloys with compositions within the teachings of the present disclosure in the 700° C./1,000 h/AC condition have a 700° C. UTS equal to about 1.0 the 700° C. UTS of Alloy 740H, a 700° C. YS equal to about 1.0 the 700° C. YS of Alloy 740H, a 700° C. percent elongation equal to about 0.80 the 700° C. percent elongation of Alloy 740H, and a 700° C. ROA equal to about 0.71 the 700° C. ROA of Alloy 740H.

Referring to Tables 13 and 14, 700° C. (1292° F.) tensile data are shown for samples in the 700° C./5,000 h/AC condition.

TABLE 13

| Heat | Temp., F. | Temp., C. | UTS, ksi | UTS, MPa | YS, ksi | YS, MPa | Elong. | ROA |
|---|---|---|---|---|---|---|---|---|
| Heat 1 | 1292 | 700 | 140.2 | 966.7 | 99.9 | 688.8 | 22.5 | 29.5 |
| Heat 2 | 1292 | 700 | 136.4 | 940.5 | 96.8 | 667.4 | 22 | 28.5 |
| Heat 3 | 1292 | 700 | 141.2 | 973.6 | 100.4 | 692.3 | 24 | 31.5 |
| Heat 4 | 1292 | 700 | 141.3 | 974.3 | 98.7 | 680.5 | 21 | 27 |
| Heat 5 | 1292 | 700 | 136.8 | 943.2 | 97.1 | 669.5 | 23 | 30 |
| Heat 6 | 1292 | 700 | 137.2 | 945.0 | 98.8 | 681.2 | 26 | 31 |
| Heat 8 | 1292 | 700 | 133.8 | 922.6 | 96.9 | 668.1 | 24.5 | 33.5 |
| Heat 9 | 1292 | 700 | 146.5 | 1010.1 | 104.6 | 721.2 | 21.6 | 27.9 |
| Heat 10 | 1292 | 700 | 140.9 | 971.5 | 102.4 | 706.0 | 20.5 | 26 |
| Heat 11 | 1292 | 700 | 136.5 | 941.2 | 98.7 | 680.5 | 18 | 22.5 |
| Heat 12 | 1292 | 700 | 143 | 986.0 | 101.9 | 702.6 | 20 | 27 |
| Heat 13 | 1292 | 700 | 135.6 | 935.0 | 100.5 | 692.9 | 26 | 32.5 |
| Heat 14 | 1292 | 700 | 132.8 | 915.7 | 99 | 682.6 | 22.5 | 33 |
| Heat 19 | 1292 | 700 | 137.6 | 948.8 | 99.5 | 686.1 | 26.5 | 37.5 |

TABLE 14

| Heat | Temp., F. | Temp., C. | UTS, ksi | UTS, Mpa | YS, ksi | YS, Mpa | Elong. | ROA |
|---|---|---|---|---|---|---|---|---|
| Heat 20 | 1382 | 750 | 120.2 | 828.8 | 91.6 | 631.6 | 28.2 | 33.2 |
| Heat 20 | 1382 | 750 | 111.1 | 766.0 | 95.0 | 655.0 | 22.2 | 29.6 |
| Heat 21 | 1382 | 750 | 111.0 | 765.3 | 92.4 | 637.1 | 21.2 | 27.4 |
| Heat 21 | 1382 | 750 | 109.1 | 752.2 | 92.0 | 634.3 | 28.5 | 29.6 |
| Heat 22 | 1382 | 750 | 108.4 | 747.4 | 85.0 | 586.1 | 23.8 | 24.7 |
| Heat 22 | 1382 | 750 | 108.1 | 745.3 | 90.2 | 621.9 | 21.3 | 29.3 |

As shown in Tables 13 and 14, Heats 2, 5, 6, 10, 12, and 20-22 (Heat 7 not tested) in the 700° C./5,000 h/AC condition have a minimum 700° C. UTS of 940.5 MPa (136.4 ksi), a minimum 700° C. YS of 667.4 MPa (96.8 ksi), a minimum 700° C. percent elongation of 20.0%, and a minimum 700° C. ROA of 26.0%. That is, in some variations of the present disclosure, alloys with a composition within the teachings of the present disclosure in the 700° C./5,000 h/AC condition have a minimum 700° C. UTS of 940.5 MPa (136.4 ksi), a minimum 700° C. YS of 667.4 MPa (96.8 ksi), a minimum 700° C. percent elongation of 20.0%, and minimum 700° C. ROA of 26.0%. In contrast, Heat 11 in the 700° C./5,000 h/AC condition has a 700° C. percent elongation of 18.0% and a 700° C. ROA of 22.5%.

In addition, the commercial alloy Heat 19 in the 700° C./5,000 h/AC condition has a 700° C. UTS of 948.8 MPa (137.6 ksi), a 700° C. 0.2% YS of 686.1 MPa (99.5 ksi), a 700° C. percent elongation of 26.5%, and a 700° C. percent ROA of 37.5%. Accordingly, the alloys with compositions within the teachings of the present disclosure in the 700° C./5,000 h/AC condition have a 700° C. UTS equal to about 0.99 the 700° C. UTS of Alloy 740H, a 700° C. YS equal to about 0.97 the 700° C. YS of Alloy 740H, a 700° C. percent elongation equal to about 0.76 the 700° C. percent elongation of Alloy 740H, and a 700° C. ROA equal to about 0.69 the 700° C. ROA of Alloy 740H.

Referring to Table 15, RT impact test data are shown for samples in the solution annealed+aged condition.

TABLE 15

| Heat | Average Ft. Lb | Average J/cm$^2$ |
|---|---|---|
| Heat 1 | 47.7 | 80.9 |
| Heat 2 | 57.1 | 96.8 |
| Heat 3 | 57.1 | 96.8 |
| Heat 4 | 56.2 | 95.3 |
| Heat 5 | 51.3 | 87.0 |
| Heat 6 | 63.6 | 107.8 |
| Heat 8 | 45.8 | 77.6 |
| Heat 9 | 45.3 | 76.8 |
| Heat 10 | 61.6 | 104.4 |
| Heat 11 | 54.5 | 92.4 |
| Heat 12 | 59.1 | 100.2 |
| Heat 13 | 64.3 | 109.0 |
| Heat 14 | 66.5 | 112.7 |
| Heat 15 | 79.5 | 134.8 |
| Heat 16 | 96.1 | 162.8 |
| Heat 17 | 104.6 | 177.4 |
| Heat 18 | 79.5 | 134.8 |
| Heat 7 | 71.6 | 121.3 |
| Heat 19 | 67.7 | 114.7 |

As shown in Table 15, the heats with compositions within the teachings of the present disclosure (i.e., Heats 2, 5, 6, 7, 10, and 12) in the solution annealed+aged condition have a minimum RT impact energy of 87.0 J/cm$^2$ (51.3 Ft.lb). That is, in some variations of the present disclosure, alloys with a composition within the teachings of the present disclosure in the solution annealed+aged condition have a minimum RT impact energy of 87.0 J/cm$^2$ (51.3 Ft.lb). In contrast, Heat 1 in the solution annealed+aged condition has a RT impact energy of 80.9 J/cm$^2$ (47.7 ft.lb), Heat 8 in the solution annealed+aged condition has a RT impact energy of 77.6 J/cm$^2$ (45.8 ft.lb), and Heat 9 in the solution annealed+aged condition has a RT impact energy of 76.8 J/cm$^2$ (45.3 ft.lb). In addition, the commercial alloy Heat 19 in the solution annealed+aged condition has a RT impact energy of 114.7 J/cm$^2$ (67.7 ft.lb). Accordingly, the alloys with compositions within the teachings of the present disclosure in the solution annealed+aged condition have a RT impact energy equal to about 0.76 the RT impact energy of Alloy 740H.

Referring to Tables 16 and 17, RT impact testing data are shown for samples in the 700° C./1,000 h/AC condition.

TABLE 16

| Heat | Average Ft. Lb | Average Joules/Cm$^2$ |
|---|---|---|
| Heat 1 | 18.3 | 31.1 |
| Heat 2 | 24.0 | 40.7 |
| Heat 3 | 20.7 | 35.0 |
| Heat 4 | 13.7 | 23.2 |
| Heat 5 | 18.3 | 31.1 |
| Heat 6 | 33.3 | 56.5 |
| Heat 8 | 18.3 | 31.1 |
| Heat 9 | 17.0 | 28.8 |
| Heat 10 | 14.7 | 24.9 |
| Heat 11 | 24.3 | 41.2 |
| Heat 12 | 14.0 | 23.7 |
| Heat 13 | 29.7 | 50.3 |

TABLE 16-continued

| Heat | Average Ft. Lb | Average Joules/Cm$^2$ |
|---|---|---|
| Heat 14 | 17.3 | 29.4 |
| Heat 15 | 10.2 | 17.3 |
| Heat 16 | 9.3 | 15.7 |
| Heat 17 | 7.9 | 13.4 |
| Heat 18 | 7.2 | 12.3 |
| Heat 7 | 15.1 | 25.5 |
| Heat 19 | 14.3 | 24.3 |

TABLE 17

| Heat | Average Ft. Lb. | Average J/cm$^2$ |
|---|---|---|
| Heat 22 | 18.7 | 31.7 |
| Heat 21 | 18.8 | 31.9 |
| Heat 20 | 24.4 | 41.4 |

As shown in Tables 16 and 17, the heats with compositions within the teachings of the present disclosure (i.e., Heats 2, 5, 6, 7, 10, 12, and 20-22) in the 700° C./1,000 h/AC condition have a minimum RT impact energy of 23.7 J/cm$^2$ (14.0 Ft.lb). That is, in some variations of the present disclosure, alloys with a composition within the teachings of the present disclosure in the 700° C./1,000 h/AC condition have a minimum RT impact energy of 23.7 J/cm$^2$ (14.0 Ft.lb). In contrast, Heat 4 in the 700° C./1,000 h/AC condition has a RT impact energy of 23.2 J/cm$^2$ (13.7 ft.lb), Heat 15 in the 700° C./1,000 h/AC condition has a RT impact energy of 17.3 J/cm$^2$ (10.2 ft.lb), Heat 16 in the 700° C./1,000 h/AC condition has a RT impact energy of 15.7 J/cm$^2$ (9.3 ft.lb), Heat 17 in the 700° C./1,000 h/AC condition has a RT impact energy of 13.4 J/cm$^2$ (7.9 ft.lb), and Heat 18 in the 700° C./1,000 h/AC condition has a RT impact energy of 12.3 J/cm$^2$ (7.2 ft.lb). In addition, the commercial alloy Heat 19 in the 700° C./1,000 h/AC condition has a RT impact energy of 24.3 J/cm$^2$ (14.3 ft.lb). Accordingly, the alloys with compositions within the teachings of the present disclosure in the solution annealed+aged condition have a RT impact energy equal to about 0.98 the 700° C. RT impact energy of Alloy 740H.

Referring to Table 18, stress rupture data at 700° C. (1292° F.) are shown for samples in the solution annealed+aged condition. As shown in Table 18, Heats 2, 5, 6, 10, and 12 (Heat 7 not tested) solution annealed+aged condition have a minimum stress rupture life at 700° C. (1292° F.) of 1,396 hours (h) under a stress of 393.7 MPa (57.1 ksi). In contrast, at 700° C. (1292° F.) under a load of 393.7 MPa (57.1 ksi), Heats 1, 3, 8, 9, 11, 13, and 14 in the solution annealed+aged condition have a stress rupture life of 1197.5 h, 1055 h, 1124.5 h, 1079 h, 464 h, 678 h, and 692 h, respectively.

TABLE 18

| Heat | Stress, ksi | Life, h | El, % | R of A, % | 740H Stress for Same Life, ksi | % of 740H |
|---|---|---|---|---|---|---|
| Heat 1 | 57.1 | 1197.5 | 10.8 | 10.9 | 59.89 | 0.95 |
| Heat 1 | 76.2 | 58.9 | 4.3 | 2.9 | 87.01 | 0.88 |
| Heat 2 | 65.3 | 137.2 | 5.9 | 4.5 | 78.67 | 0.83 |
| Heat 2 | 76.2 | 125.4 | 5.8 | 2.6 | 79.51 | 0.96 |
| Heat 3 | 57.1 | 1055 | 9 | 12.6 | 60.87 | 0.94 |
| Heat 3 | 70.0 | 191.8 | 8.3 | 8.8 | 75.53 | 0.93 |
| Heat 3 | 76.2 | 100.2 | 7.4 | 4.1 | 81.65 | 0.93 |
| Heat 4 | 57.1 | 1849.8 | 14.5 | 9.2 | 56.50 | 1.01 |
| Heat 4 | 65.3 | 483 | 3.4 | 5.8 | 67.32 | 0.97 |

TABLE 18-continued

| Heat | Stress, ksi | Life, h | El, % | R of A, % | 740H Stress for Same Life, ksi | % of 740H |
|---|---|---|---|---|---|---|
| Heat 4 | 76.2 | 115 | 6 | 3.6 | 80.35 | 0.95 |
| Heat 5 | 57.1 | 1644 | 16.4 | 22.3 | 57.40 | 0.99 |
| Heat 5 | 65.3 | 391.7 | 10.5 | 9.6 | 69.12 | 0.94 |
| Heat 5 | 76.2 | 81.3 | 6.3 | 3.8 | 83.71 | 0.91 |
| Heat 6 | 57.1 | 1959 | 22 | 29 | 56.07 | 1.02 |
| Heat 6 | 65.3 | 284.4 | 8.6 | 8.8 | 71.94 | 0.91 |
| Heat 6 | 76.2 | 135.2 | 8.6 | 6.5 | 78.75 | 0.97 |
| Heat 8 | 57.1 | 1124.5 | 15.1 | 11.1 | 60.36 | 0.95 |
| Heat 8 | 65.3 | 418.8 | 17.4 | 10.4 | 68.54 | 0.95 |
| Heat 8 | 76.2 | 94.1 | 10.8 | 6.6 | 82.36 | 0.93 |
| Heat 9 | 57.1 | 1079 | 12.6 | 16.6 | 60.68 | 0.94 |
| Heat 9 | 65.3 | 484 | 8.8 | 16.2 | 67.30 | 0.97 |
| Heat 10 | 65.3 | 637 | 9.9 | 17.3 | 64.99 | 1.00 |
| Heat 11 | 57.1 | 464 | 4.8 | 8.6 | 67.65 | 0.84 |
| Heat 12 | 57.1 | 1396 | 11 | 20.5 | 58.67 | 0.97 |
| Heat 12 | 65.3 | 520 | 9.7 | 16.9 | 66.69 | 0.98 |
| Heat 13 | 57.1 | 678 | 6.2 | 12.8 | 64.47 | 0.89 |
| Heat 13 | 65.3 | 278 | 10 | 19 | 72.15 | 0.91 |
| Heat 14 | 57.1 | 692 | 5.2 | 10.9 | 64.29 | 0.89 |
| Heat 14 | 65.3 | 409 | 12.7 | 19.8 | 68.75 | 0.95 |

In addition, the alloys with compositions within the teachings of the present disclosure in the solution annealed+aged condition have minimum stress rupture life at 700° C. (1292° F.) equal to about 0.99 the minimum stress rupture life at 700° C. (1292° F.) of Alloy 740H under a stress of 393.7 MPa (57.1 ksi) (as estimated from a composite of known data for Alloy 740H).

As discussed above with respect to Tables 1-18, the teachings of the present disclosure provide a Ni-base alloy a desired combination of mechanical properties and low Co content. Stated differently, the teachings of the present disclosure provide a Ni-base alloy with mechanical properties similar to the Alloy 740H, but with significantly less Co and thus reduced cost. Particularly, alloys with compositions within the teachings of the present disclosure have a RT UTS of at least 0.96 the RT UTS of Alloy 740H, a RT YS of at least 0.92 the RT YS of Alloy 740H, a RT percent elongation of at least 0.65 the RT percent elongation of Alloy 740H, and a RT ROA of at least 0.60 the RT ROA of Alloy 740H. Also, alloys with compositions within the teachings of the present disclosure have a 700° C. UTS of at least 0.95 the 700° C. UTS of Alloy 740H, a 700° C. YS of at least 0.97 the 700° C. YS of Alloy 740H, a 700° C. percent elongation of at least 0.57 the 700° C. percent elongation of Alloy 740H, and a 700° C. ROA of at least 0.65 the 700° C. ROA of Alloy 740H. And alloys with compositions within the teachings of the present disclosure have a RT impact energy equal of at least 0.76 the RT impact energy of Alloy 740H and a stress rupture life at 700° C. (1292° F.) and 393.7 MPa (57.1 ksi) of at least 0.99 the stress rupture life at 700° C. (1292° F.) and 393.7 MPa (57.1 ksi) of Alloy 740H. Accordingly, a low cost alloy, compared to Alloy 740H, with high temperature mechanical and corrosion resistant properties for use in such environments or industries such as USC and A-USC boilers, and power systems employing supercritical $CO_2$ ($sCO_2$) as the heat transfer medium is provided, and the alloy can be used for high temperature fasteners, springs and valves. In addition, the high nickel content provides an alloy with favorable weldability and fabricability.

Figure 2:
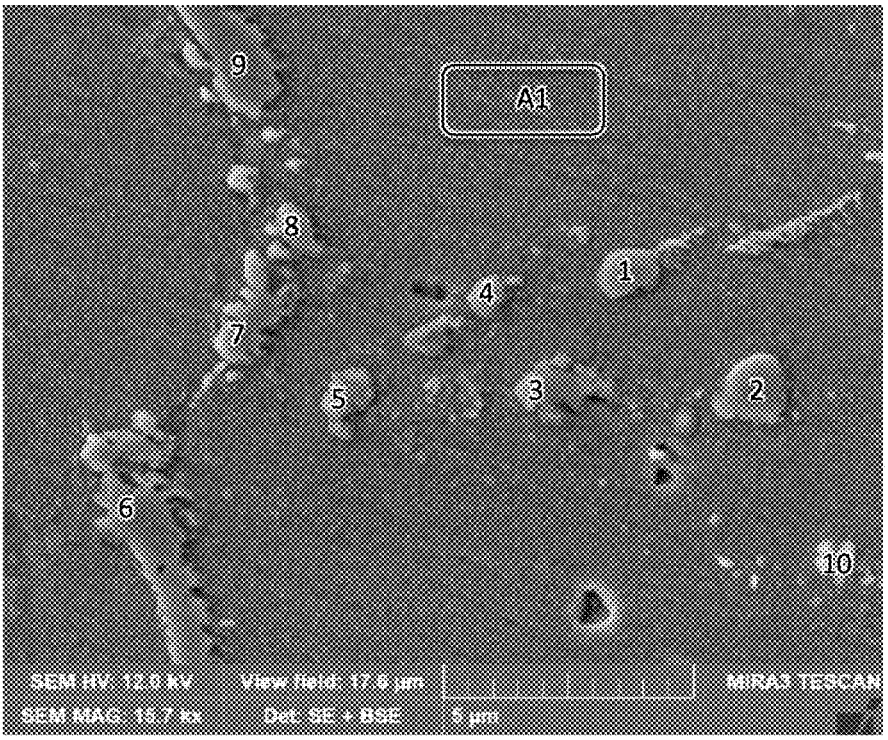
FIG. 2 shows a higher magnification of a portion of the micrograph in FIG. 1 with a plurality of locations that were analyzed via energy dispersive spectroscopy (EDS) identified.
Figure 3:
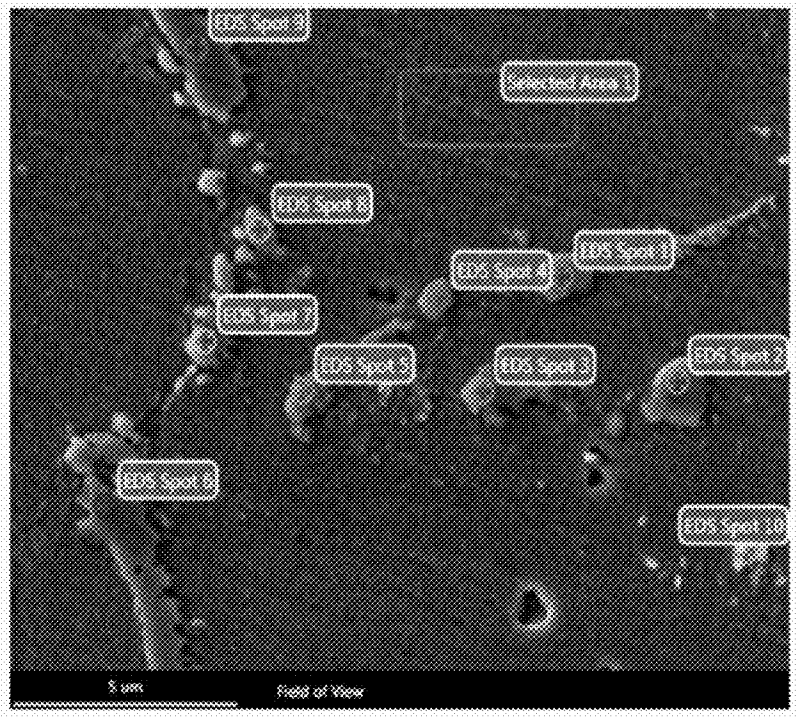
FIG. 3 shows results of the EDS analysis of a portion of the microstructure from FIGS. 1 and 2.

Referring to FIGS. 1-2, SEM (scanning electron microscopy) images of stress-rupture samples from one heat are shown, and results from energy dispersive spectroscopy (EDS) are shown in FIG. 3. Based on the EDS analysis, two (2) types of precipitates were identified. First, precipitates of Nb, Ti and carbides were identified, and second, precipitates of Cr and Mo were identified. As shown, the grain boundaries of the alloy according to the present disclosure are well defined, and in some forms of the present disclosure, the grain size is ASTM #2-4 with an average grain size of about 100 μm. SEM and X-Ray diffraction analysis showed primarily chromium-rich carbide (M23C6) on the grain boundaries with MC-type carbo-nitrides (Nb, Ti rich), which were primarily intra-granular.

Unless otherwise expressly indicated herein, all numerical values indicating mechanical/thermal properties, compositional percentages, dimensions and/or tolerances, or other characteristics are to be understood as modified by the word "about" or "approximately" in describing the scope of the present disclosure. This modification is desired for various reasons including industrial practice, material, manufacturing, and assembly tolerances, and testing capability.

As used herein, the phrase at least one of A, B, and C should be construed to mean a logical (A OR B OR C), using a non-exclusive logical OR, and should not be construed to mean "at least one of A, at least one of B, and at least one of C."

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. An alloy comprising:

a composition, in weight percent, comprising:
aluminum from about 1.3% to about 1.8%;
cobalt from about 1.5% to about 4.0%;
chromium from about 18.0% to about 22.0%;
iron from about 4.0% to about 10.0%;
molybdenum from about 1.0% to about 3.0%;
niobium from about 1.0% to about 2.5%;
titanium from about 1.3% to about 1.8%;
tungsten from about 0.8% to about 1.2%;
carbon from about 0.01% to about 0.08%; and
balance nickel and incidental impurities;

a stress rupture life at 700° C. and 393.7 MPa (57.1 ksi) of at least 300 hours; and a room temperature percent elongation of at least 19% after aging at 700° C. for 1,000 hours.

2. The alloy according to claim 1, wherein the cobalt is from about 2.0% to about 3.0%.

3. The alloy according to claim 1, wherein the molybdenum is from about 1.0% to about 2.75%.

4. The alloy according to claim 1, wherein the niobium is from about 1.0% to about 1.75%.

5. The alloy according to claim 1, wherein the cobalt is from about 2.0% to about 3.0% and the molybdenum is from about 1.0% to about 2.75%.

6. The alloy according to claim 1, wherein the cobalt is from about 2.0% to about 3.0% and the niobium is from about 1.0% to about 1.75%.

7. The alloy according to claim 1, wherein the molybdenum is from about 1.0% to about 2.75% and the niobium is from about 1.0% to about 1.75%.

8. The alloy according to claim 1, wherein the cobalt is from about 2.0% to about 3.0%, the molybdenum is from about 1.0% to about 2.75%, and the niobium is from about 1.0% to about 1.75%.

9. The alloy according to claim 1, wherein the stress rupture life at 700° C. and 393.7 MPa (57.1 ksi) is at least 500 hours.

10. The alloy according to claim 1, wherein the room temperature percent elongation is at least 20% after aging at 700° C. for 1,000 hours.

11. The alloy according to claim 1, wherein the room temperature percent elongation is at least 22% after aging at 700° C. for 1,000 hours.

12. The alloy according to claim 1 further comprising a room temperature percent elongation of at least 17% after aging at 700° C. for 5,000 hours.

13. The alloy according to claim 1, wherein the room temperature percent elongation is at least 20% after aging at 700° C. for 5,000 hours.

14. The alloy according to claim 1 further comprising a room temperature impact energy of at least 12 ft-lb upon aging at 700° C. for 1,000 hours.

15. The alloy according to claim 14, wherein the room temperature impact energy is at least 15 ft-lb upon aging at 700° C. for 1,000 hours.

16. The alloy according to claim 15, wherein the room temperature impact energy is at least 20 ft-lb upon aging at 700° C. for 1,000 hours.

17. The alloy according to claim 1 further comprising a room temperature impact energy of at least 10 ft-lb upon aging at 700° C. for 5,000 hours.

18. The alloy according to claim 1, wherein a room temperature impact energy of the alloy is at least 12 ft-lb upon aging at 700° C. for 5,000 hours.

19. The alloy according to claim 1, wherein a room temperature impact energy of the alloy is at least 15 ft-lb upon aging at 700° C. for 5,000 hours.

20. The alloy according to claim 1 further comprising a room temperature (RT) ultimate tensile strength between about 160 ksi (1104 MPa) and about 175 ksi (1207 MPa), a RT 0.2% yield strength between about 95 ksi (655 MPa) and 115 ksi (793 MPa), and a RT percent elongation between about 30% and 45%, after annealing the alloy at 788° C. (1450° F.) for 4 hours followed by air cooling.

21. The alloy according to claim 20, wherein the RT ultimate tensile strength is between about 160 ksi (1104 MPa) and about 170 ksi (1172 MPa), the RT 0.2% yield strength is between about 95 ksi (655 MPa) and 110 ksi (758 MPa), and the RT percent elongation is between about 35% and 45%, after annealing the alloy at 788° C. (1450° F.) for 4 hours followed by air cooling.

22. The alloy according to claim 1 further comprising a room temperature (RT) ultimate tensile strength between about 175 ksi (1207 MPa) and about 195 ksi (1344 MPa), a RT 0.2% yield strength between about 105 ksi (724 MPa) and 125 ksi (861 MPa), and a RT percent elongation between about 19% and 30%, after annealing the alloy at 788° C. (1450° F.) for 4 hours followed by air cooling and aging the alloy at 700° C. (1292° F.) for 1,000 hours followed by air cooling.

23. The alloy according to claim 22, wherein the RT ultimate tensile strength is between about 175 ksi (1207 MPa) and about 185 ksi (1275 MPa), the RT 0.2% yield strength is between about 105 ksi (724 MPa) and 120 ksi (827 MPa), and the RT percent elongation is between about 22% and 30%, after annealing the alloy at 788° C. (1450° F.) for 4 hours followed by air cooling and aging the alloy at 700° C. (1292° F.) for 1,000 hours followed by air cooling.

24. The alloy according to claim 1 further comprising a room temperature (RT) ultimate tensile strength between about 170 ksi (1172 MPa) and about 200 ksi (1379 MPa), a RT 0.2% yield strength between about 100 ksi (689 MPa) and about 120 ksi (827 MPa), and a RT percent elongation between about 16% and 30%, after annealing the alloy at 788° C. (1450° F.) for 4 hours followed by air cooling and aging the alloy at 700° C. (1292° F.) for 5,000 hours followed by air cooling.

25. The alloy according to claim 24, wherein the RT ultimate tensile strength is between about 175 ksi (1207 MPa) and about 190 ksi (1310 MPa), the RT 0.2% yield strength is between about 105 ksi (724 MPa) and about 115 ksi (793 MPa), and the RT percent elongation is between about 20% and 30%, after annealing the alloy at 788° C. (1450° F.) for 4 hours followed by air cooling and aging the alloy at 700° C. (1292° F.) for 5,000 hours followed by air cooling.

26. The alloy according to claim 1 further comprising a 700° C. ultimate tensile strength between about 130 ksi (896 MPa) and about 155 ksi (1069 MPa), a 700° C. 0.2% yield strength between about 90 ksi (620 MPa) and about 105 ksi (724 MPa), and a 700° C. percent elongation between about 9% and 25%, after annealing the alloy at 788° C. (1450° F.) for 4 hours followed by air cooling.

27. The alloy according to claim 26, wherein the 700° C. ultimate tensile strength is between about 125 ksi (861 MPa) and about 140 ksi (965 MPa), the 700° C. 0.2% yield strength is between about 90 ksi (620 MPa) and 100 ksi (689 MPa), and the 700° C. percent elongation is between about 14% and 20%, after annealing the alloy at 788° C. (1450° F.) for 4 hours followed by air cooling.

28. The alloy according to claim 1 further comprising a 700° C. ultimate tensile strength between about 135 ksi (931 MPa) and about 155 ksi (1069 MPa), a 700° C. 0.2% yield strength between about 95 ksi (655 MPa) and about 110 ksi (758 MPa), and a 700° C. percent elongation between about 12% and 30%, after annealing the alloy at 788° C. (1450° F.) for 4 hours followed by air cooling and aging the alloy at 700° C. (1292° F.) for 1,000 hours followed by air cooling.

29. The alloy according to claim 28, wherein the 700° C. ultimate tensile strength is between about 135 ksi (931 MPa) and about 150 ksi (1034 MPa), the 700° C. 0.2% yield strength is between about 95 ksi (655 MPa) and 105 ksi (724 MPa), and the 700° C. percent elongation is between about 15% and 30%, after annealing the alloy at 788° C. (1450° F.) for 4 hours followed by air cooling and aging the alloy at 700° C. (1292° F.) for 1,000 hours followed by air cooling.

30. The alloy according to claim 1 further comprising a 700° C. ultimate tensile strength between about 130 ksi (896 MPa) and about 150 ksi (1034 MPa), a 700° C. 0.2% yield strength between about 90 ksi (620 MPa) and about 110 ksi (758 MPa), and a 700° C. percent elongation between about 15% and 28%, after annealing the alloy at 788° C. (1450° F.) for 4 hours followed by air cooling and aging the alloy at 700° C. (1292° F.) for 5,000 hours followed by air cooling.

31. The alloy according to claim 30, wherein the 700° C. ultimate tensile strength is between about 130 ksi (896 MPa) and about 145 ksi (1000 MPa), the 700° C. 0.2% yield strength is between about 90 ksi (620 MPa) and 102 ksi (703 MPa), and the 700° C. percent elongation is between about 15% and 25%, after annealing the alloy at 788° C. (1450° F.) for 4 hours followed by air cooling and aging the alloy at 700° C. (1292° F.) for 5,000 hours followed by air cooling.

32. The alloy according to claim 1 further comprising:
manganese from about 0.02% to about 0.3%;
silicon from about 0.05% to about 0.3%;
vanadium from about 0.005% to about 0.2%;
zirconium from about 0.005% to about 0.2%;
boron from about 0.001% to about 0.025%; and
nitrogen from about 0.001% to about 0.02%.

* * * * *